US012773596B2

(12) United States Patent
Pierce

(10) Patent No.: US 12,773,596 B2
(45) Date of Patent: Oct. 27, 2026

(54) POOL NOODLE PLUG APPARATUS AND METHOD

(71) Applicant: Eric Pierce, Lubbock, TX (US)

(72) Inventor: Eric Pierce, Lubbock, TX (US)

( * ) Notice: Subject to any disclaimer, the term of this patent is extended or adjusted under 35 U.S.C. 154(b) by 234 days.

(21) Appl. No.: 18/772,095

(22) Filed: Jul. 12, 2024

(65) Prior Publication Data

US 2025/0018249 A1 Jan. 16, 2025

Related U.S. Application Data

(60) Provisional application No. 63/513,166, filed on Jul. 12, 2023.

(51) Int. Cl.
*A63B 31/00* (2006.01)

(52) U.S. Cl.
CPC ..... *A63B 31/00* (2013.01); *A63B 2225/605* (2013.01)

(58) Field of Classification Search
CPC ... A63B 31/00; A63B 2225/605; A63B 69/10; A63B 69/14; B63C 9/00
See application file for complete search history.

(56) References Cited

U.S. PATENT DOCUMENTS 3,753,500 A * 8/1973 Voegeli ..... B01D 35/02 210/446
5,490,805 A * 2/1996 Bredesen ..... B63B 32/73 242/379.2
6,123,858 A * 9/2000 Manz ..... B01D 24/42 210/744
6,276,979 B1 * 8/2001 Saltel ..... B63B 34/50 441/132
6,390,446 B1 * 5/2002 Wang ..... B01D 35/02 210/429
D729,333 S * 5/2015 Arnold ..... D21/803
9,168,986 B1 * 10/2015 Wachter ..... B63B 34/50
9,314,119 B2 * 4/2016 Parker ..... A45F 3/16
9,457,876 B1 * 10/2016 Godfrey ..... B63B 34/50
10,238,984 B2 * 3/2019 Liberatore ..... A63G 31/007
11,208,177 B2 * 12/2021 January ..... A47C 15/006
2021/0093924 A1 * 4/2021 Brown ..... A63B 69/14
2023/0211855 A1 * 7/2023 Wittlieff ..... A63B 31/00 441/47
2025/0018249 A1 * 1/2025 Pierce ..... A63B 31/00
2026/0008531 A1 * 1/2026 Brown ..... B63C 9/00

* cited by examiner

*Primary Examiner* — Marc Q Jimenez
*Assistant Examiner* — Jovon E Hayes
(74) *Attorney, Agent, or Firm* — TILLMAN WRIGHT, PLLC; Chad D. Tillman

(57) ABSTRACT

A flotation apparatus includes an elongate, buoyant body having first and second opposite, longitudinal ends and a hollow core defining a passageway extending between the first and second ends; and a first plug entirely located within the hollow core proximate the first longitudinal end and a second plug entirely located within the hollow core proximate the second longitudinal end. The first and second plugs are configured to prevent bugs, mice, and snakes from entering the passageway extending between the first and second plugs. Each of the first and second plugs defines openings therein for venting moisture from the passageway extending between and enclosed by the first and second plugs. The first and second plugs engage in a frictional fit with a wall of the passageway defined by the hollow core and do not protrude out of the passageway. The flotation apparatus preferably is a pool noodle.

19 Claims, 3 Drawing Sheets

POOL NOODLE PLUG APPARATUS AND METHOD

CROSS-REFERENCE TO RELATED APPLICATION

The present application is a U.S. nonprovisional patent application of, and claims priority under 35 U.S.C. § 119 (e) to, U.S. provisional patent application 63/513,166, filed Jul. 12, 2023, which is incorporated herein by reference.

COPYRIGHT STATEMENT

Any new and original work of authorship in this document is subject to copyright protection under the copyright laws of the United States and other countries. Reproduction by anyone of this document as it appears in official governmental records is permitted, but otherwise all other copyright rights whatsoever are reserved.

BACKGROUND OF THE INVENTION

The invention generally relates to the field of swimming pool accessories and, more particularly, to flotation apparatus known as "pool noodles".

Pool noodles are popular flotation devices used in swimming pools and other aquatic environments. An exemplary pool noodle is disclosed, for example, in U.S. Pat. No. 9,039,473. The pool noodle includes an elongate, generally cylindrical, open-ended body with a hollow core defining a passageway between the opposite ends thereof. The body is constructed from a soft foam material that has a sufficient buoyancy to serve as a general flotation device for a user during recreational activity. Unfortunately, the passageway of the noodle can become home to bugs, mice, snakes, mold, and mildew.

To address this, solutions including caps have been developed for capping the ends of the noodle. For example, U.S. patent application publication 2021/0093924 A1 discloses a pool noodle cap for preventing debris, bugs, mice, and snakes from entering the pool noodle. Another is cap is disclosed in U.S. Pat. D769,391. While suitable for such purposes, it is believed that such caps and plugs do not adequately address the need for drainage and ventilation while preventing the entry of debris, bugs, mice, and snakes. Such caps are believed to trap moisture in the hollow core of noodle, thereby promoting mold and mildew growth. Furthermore, it noted that the cap extends past the edge of the pool noodle, and it is believed that this presents a risk of injury should the cap impact a person. Indeed, it is observed that noodles can be used for hitting others during play in the pool by children because the noodles are so soft and light.

In view of the foregoing, it is believed that a need exists for improvement in such flotation devices. This, and other needs, are believed to be addressed by one or more aspects and features of the invention.

SUMMARY OF THE INVENTION

The invention includes many aspects and features. Moreover, while many aspects and features relate to, and are described in, the context of pool noodles, the invention is not limited in its utility to use in such context, as will become apparent from the following summaries and detailed descriptions of aspects, features, and one or more embodiments of the invention.

Accordingly, one aspect of the invention relates to a flotation apparatus that is buoyant in water. The flotation apparatus comprises an elongate, buoyant body having first and second opposite, longitudinal ends and a hollow core defining a passageway extending between the first and second opposite ends. A first plug is entirely located within the hollow core proximate the first longitudinal end and a second plug is entirely located within the hollow core proximate the second longitudinal end. The first and second plugs are configured to prevent bugs, mice, and snakes from entering the passageway extending between the first and second plugs. The plugs serve as barriers to bugs, mice, and snakes.

For safety and to avoid injury, neither the first nor the second plugs preferably extend from the passageway beyond the opposite ends of the pool noodle, and no part of either plug preferably is located on an exterior of the pool noodle.

In a feature, at least one of the first and second plugs is cup shaped.

In a feature, at least one of the first and second plugs comprises a cylindrical body having a hollow interior.

In a feature, at least one of the first and second plugs comprises a solid cylindrical body.

In a feature of this aspect, at least one of the first and second plugs defines openings therein for venting moisture from the passageway extending between the first and second plugs.

In another feature, the first and second plugs comprise perforated pipe plugs.

In another feature, the elongate, buoyant body is cylindrical in shape.

In another feature, the elongate, buoyant body comprises a soft foam material.

In another feature, the passageway comprises a cylindrical passageway.

In another aspect, a flotation apparatus comprises: a pool noodle; and means for preventing bugs, mice, and snakes from entering a hollow core of the pool noodle while permitting venting of moisture from the hollow core of the pool noodle.

In a feature, the means is entirely located within the hollow core of the pool noodle.

In another aspect, an apparatus comprises a plug configured to be inserted into a hollow core of a pool noodle at a longitudinal end of the pool noodle such that the plug is entirely received within the hollow core of the pool noodle.

In a feature, the plug comprises a cylindrical body with a first end that is open ended and a second end that is closed off by a perforated wall.

In a feature, the plug comprises a cylindrical body extending approximately 20 mm between opposite ends of the plug. The cylindrical body preferably has a thickness of approximately 1 mm.

In a feature, the plug is configured with a cylindrical body with a first end that is open ended and a second end that is closed off by a perforated wall, wherein an outer diameter of the cylindrical body is approximately 28 mm.

In a feature, the plug is configured with a cylindrical body with a first end that is open ended and a second end that is closed off by a perforated wall, wherein the perforated wall has a thickness of approximately 1 mm. Alternatively, the plug is configured with the perforated wall having a thickness of approximately 2 mm.

In a feature, the plug is configured with a cylindrical body with a first end that is open ended and a second end that is closed off by a perforated wall, wherein the perforated wall comprises a plurality of oval openings each having a diameter of approximately 4 mm. Preferably, the openings of the perforated wall form a series of strategically placed drainage and ventilation holes that allow water to drain and air to circulate while preventing the entry of snakes, animals, insects, and other foreign matter.

In another aspect, a method of preventing bugs, mice, and snakes from entering a hollow core of a pool noodle that defines a passageway between first and second opposite, longitudinal ends of the pool noodle, comprises the steps of inserting a first plug into the hollow core at the first end of the pool noodle such that the first plug is entirely contained within the hollow core and does not extend from the passageway; and inserting a second plug into the hollow core at the second end of the pool noodle such that the second plug is entirely contained within the hollow core and does not extend from the passageway.

In a feature, each of the first and second plugs defines openings therein for venting moisture from the passageway extending between the first and second plugs.

In a feature, the first and second plugs comprise perforated pipe plugs.

In a feature, the elongate, buoyant body is cylindrical in shape.

In a feature, the elongate, buoyant body comprises a soft foam material.

In a feature, the passageway comprises a cylindrical passageway.

In a feature, the first and second plugs engage in a frictional fit with walls of the passageway.

In another feature of foregoing aspects, the plug is made from a durable and water-resistant material, such as high-density polyethylene (HDPE).

To enhance safety, the plug is designed to be inserted beyond an edge of the end of the pool noodle, thereby minimizing the risk of injury if the noodle is swung and impacts a person or object. The plug is held securely in place by a friction fit between the outer surface of the plug and the inner wall surface of the hollow core of the pool noodle.

Yet additional aspects and features are disclosed in the drawing, the following detailed description, the incorporated provisional patent application, and the incorporated appendix to the specification.

In addition to the aforementioned aspects and features of the invention, it should be noted that the invention further encompasses the various logical combinations and subcombinations of such aspects and features. Thus, for example, claims in this or a divisional or continuing patent application or applications may be separately directed to any aspect, feature, or embodiment disclosed herein, or combination thereof, without requiring any other aspect, feature, or embodiment.

BRIEF DESCRIPTION OF THE DRAWINGS

One or more preferred embodiments of the invention now will be described in detail with reference to the accompanying drawings, wherein the same elements are referred to with the same reference numerals.

DETAILED DESCRIPTION

Figure 1:
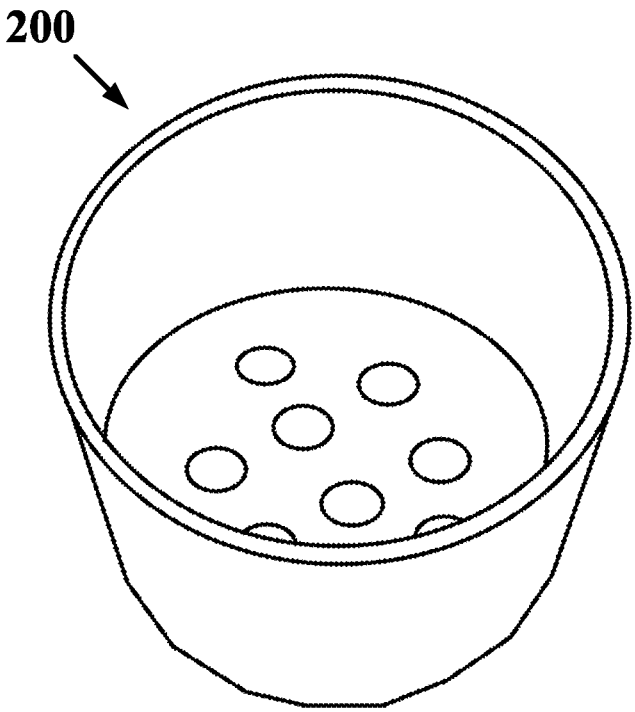
FIG. 1 is a perspective view of a top of a preferred embodiment of a prototype plug in accordance with one or more aspects and features of the invention.

As a preliminary matter, it will readily be understood by one having ordinary skill in the relevant art ("Ordinary Artisan") that the invention has broad utility and application. Furthermore, any embodiment discussed and identified as being "preferred" is considered to be part of a best mode contemplated for carrying out the invention. Other embodiments also may be discussed for additional illustrative purposes in providing a full and enabling disclosure of the invention. Furthermore, an embodiment of the invention may incorporate only one or a plurality of the aspects of the invention disclosed herein; only one or a plurality of the features disclosed herein; or combination thereof. As such, many embodiments are implicitly disclosed herein and fall within the scope of what is regarded as the invention.

Accordingly, while the invention is described herein in detail in relation to one or more embodiments, it is to be understood that this disclosure is illustrative and exemplary of the invention and is made merely for the purposes of providing a full and enabling disclosure of the invention. The detailed disclosure herein of one or more embodiments is not intended, nor is to be construed, to limit the scope of patent protection afforded the invention in any claim of a patent issuing here from, which scope is to be defined by the claims and the equivalents thereof. It is not intended that the scope of patent protection afforded the invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the invention. Accordingly, it is intended that the scope of patent protection afforded the invention be defined by the issued claim(s) rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

With regard solely to construction of any claim with respect to the United States, no claim element is to be interpreted under 35 U.S.C. 112 (f) unless the explicit phrase "means for" or "step for" is actually used in such claim element, whereupon this statutory provision is intended to and should apply in the interpretation of such claim element. With regard to any method claim including a condition precedent step, such method requires the condition precedent to be met and the step to be performed at least once but not necessarily every time during performance of the claimed method.

Furthermore, it is important to note that, as used herein, "comprising" is open-ended insofar as that which follows such term is not exclusive. Additionally, "a" and "an" each generally denotes "at least one" but does not exclude a plurality unless the contextual use dictates otherwise. Thus, reference to "a picnic basket having an apple" is the same as "a picnic basket comprising an apple" and "a picnic basket including an apple", each of which identically describes "a picnic basket having at least one apple" as well as "a picnic basket having apples"; the picnic basket further may contain one or more other items beside an apple. In contrast, reference to "a picnic basket having a single apple" describes "a picnic basket having only one apple"; the picnic basket further may contain one or more other items beside an apple. In contrast, "a picnic basket consisting of an apple" has only a single item contained therein, i.e., one apple; the picnic basket contains no other item.

When used herein to join a list of items, "or" denotes "at least one of the items" but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers"; the picnic basket further may contain one or more other items beside cheese and crackers.

When used herein to join a list of items, "and" denotes "all of the items of the list". Thus, reference to "a picnic basket having cheese and crackers" describes "a picnic basket having cheese, wherein the picnic basket further has crackers", as well as describes "a picnic basket having crackers, wherein the picnic basket further has cheese"; the picnic basket further may contain one or more other items beside cheese and crackers.

The phrase "at least one" followed by a list of items joined by "and" denotes an item of the list but does not require every item of the list. Thus, "at least one of an apple and an orange" encompasses the following mutually exclusive scenarios: there is an apple but no orange; there is an orange but no apple; and there is both an apple and an orange. In these scenarios if there is an apple, there may be more than one apple, and if there is an orange, there may be more than one orange. Moreover, the phrase "one or more" followed by a list of items joined by "and" is the equivalent of "at least one" followed by the list of items joined by "and".

Referring now to the drawings, and to the drawings in the publication of the present application, namely, U.S. Patent Application Publicatiln 2025/0018249 A1 ("the Application Publication"), which is incorporated herein by reference, one or more preferred embodiments of the invention are next described. The following description of one or more preferred embodiments is merely exemplary in nature and is in no way intended to limit the invention, its implementations, or uses.

Figure 2:
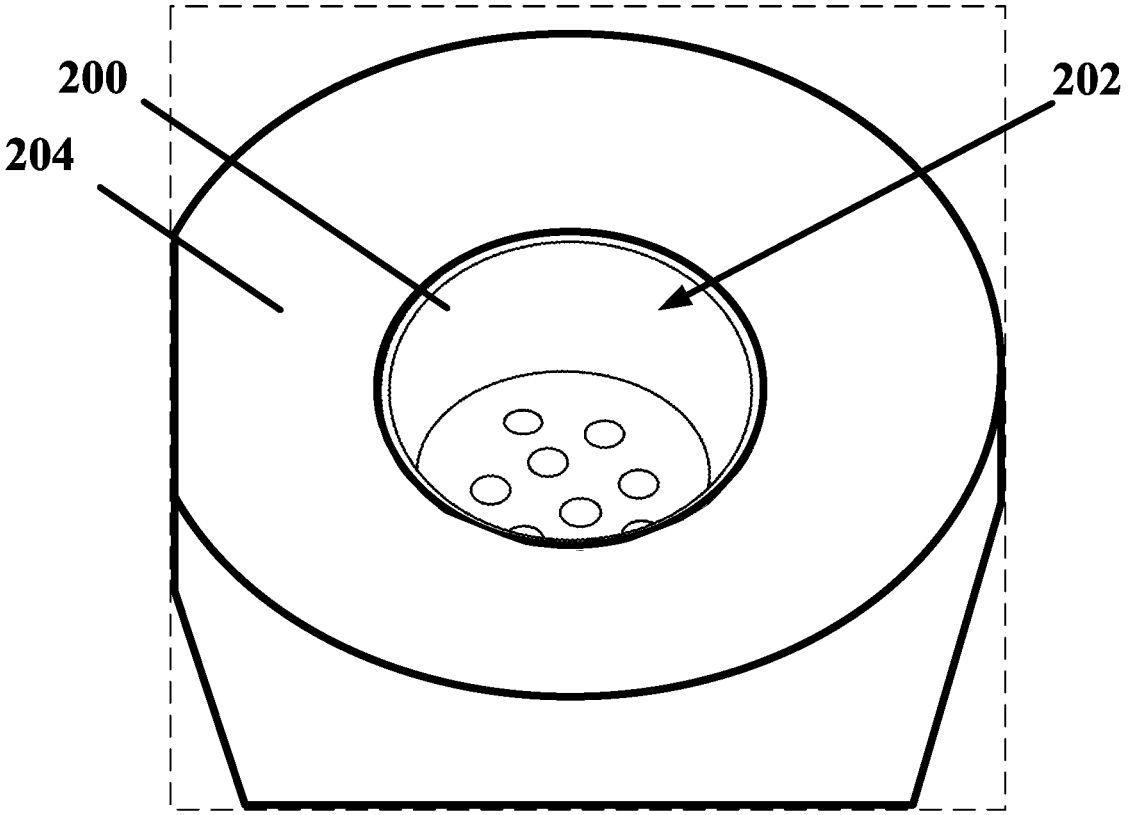
FIG. 2 is a perspective view of the prototype plug of FIG. 1 having been entirely inserted into a passageway defined by a hollow core of a pool noodle and located proximate a longitudinal end of the pool noodle.
Figure 3:
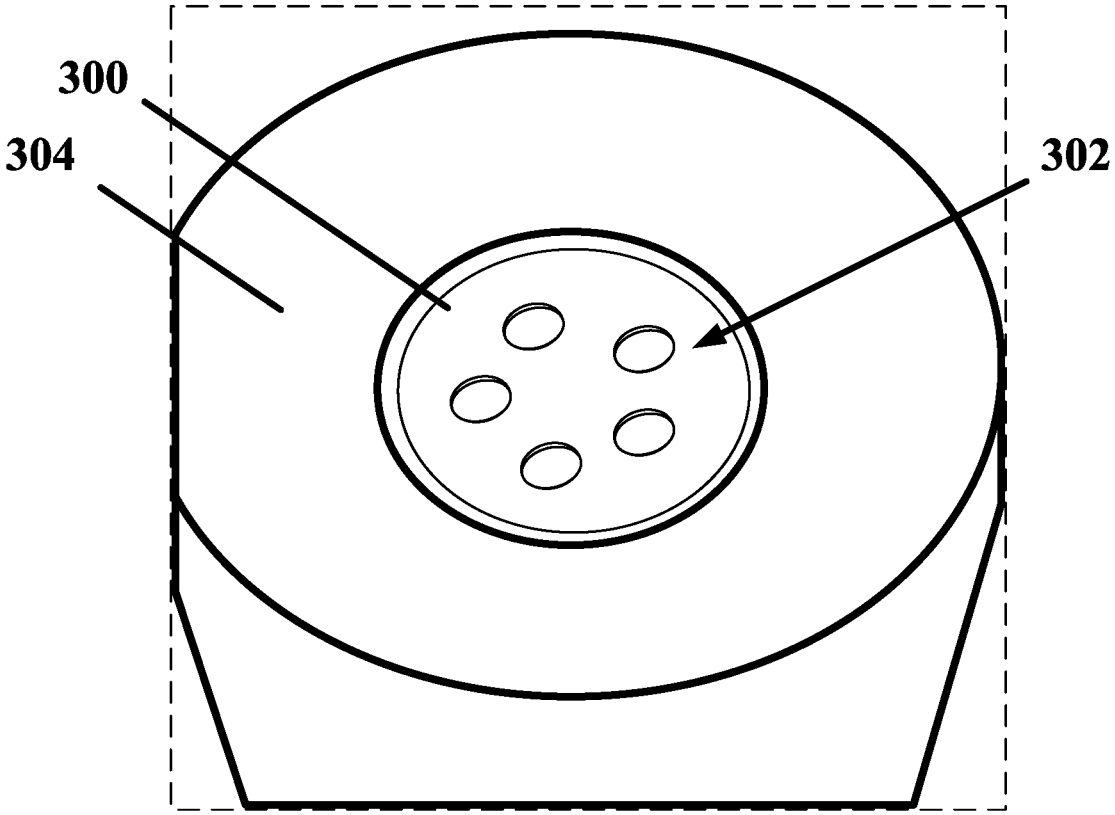
FIG. 3 is a perspective view of another preferred embodiment of a prototype plug in accordance with one or more aspects and features of the invention having been entirely inserted into a passageway defined by a hollow core of a pool noodle and located proximate a longitudinal end of the pool noodle.

Turning now to the drawings, FIG. 1 of the Application Publication is a perspective view of a front of a preferred embodiment of a plug 100 in accordance with one or more aspects and features of the invention, the rear side being a mirror image thereof; and FIG. 2 of the Application Publication is a perspective view of a side of the plug 100. The opposite side of the plug is a mirror image of the view of FIG. 2 of the Application Publication. FIG. 3 of the Application Publication is perspective view of a top of the plug 100 looking into through a hollow portion 102 of the plug to a perforated bottom wall 104 of the plug defining an end of the plug. As shown in FIGS. 1-3 of the Application Publication, the plug 100 comprises a cylindrical body having a hollow interior and is cup shaped. The plug 100 preferably is made from a durable and water-resistant material, such as high-density polyethylene (HDPE). The material of the plug also may be UV light resistant and preferably resistant to chemicals commonly found in pools. The material itself also may be resistant to mold and mildew growth.

FIG. 4 of the Application Publication is a perspective view of a top of a prototype plug 200 of which the plug 100 is representative. FIG. 1 corresponds to FIG. 4 of the Application Publication and is a perspective view of a top of the plug 200. Additionally, FIG. 5 of the Application Publication is a top view of the prototype plug 200; FIG. 6 of the Application Publication is a perspective view of a bottom of the prototype plug 200; and FIG. 7 of the Application Publication is an elevational view of the prototype plug 200. The elevational view is representative of the elevational views of the front, rear, and sides of this prototype plug 200.

FIG. 8 of the Application Publication is a perspective view of the prototype plug 200 having been entirely inserted into a passageway defined by a hollow core 202 of a pool noodle 204 and located proximate a longitudinal end of the pool noodle. FIG. 2 herein corresponds to FIG. 8 of the Application Publication. Moreover, FIG. 9 of the Application Publication is a top view of the flotation apparatus 206 of FIG. 8 of the Application Publication comprising the plug 200 and the pool noodle 204.

The pool noodle is buoyant in water and comprises an elongate body having first and second opposite, longitudinal ends. The elongate buoyant body typically is cylindrical in shape and comprises a soft foam material.

The hollow core of the pool noodle defines a cylindrical passageway extending between the first and second opposite ends, one of which is shown in FIGS. 8 and 9 of the Application Publication. The other, opposite end is the same as that shown in FIGS. 8 and 9 of the Application Publication and preferably includes a second plug similarly situated within the hollow core proximate that end. The second plug may be the same as the prototype plug 200 or may be an alternative embodiment of a plug in accordance with one or more aspects and features of the invention.

The plugs are configured and function to prevent bugs, mice, and snakes from entering the passageway enclosed by and extending through the pool noodle between the plugs. Additionally, each of the plugs is entirely located within the hollow core proximate its respective end of the pool noodle and does not extend from the passageway defined by the hollow core. This is for safety and to avoid injury; neither the first plug nor the second plug extends from the passageway beyond the opposite ends of the pool noodle, and no part of either plug is located on an exterior of the pool noodle.

As further shown, the plug 200 comprises a cylindrical body with a first end that is open ended and a second end that is closed off by a perforated wall that defines a plurality of openings for circulating air and venting moisture from the enclosed passageway of the pool noodle. In some embodiments the plug resembles a perforated pipe plug.

Preferably, the cylindrical body of the plug extends approximately 20 mm between its opposite ends of the plug. Additionally, the cylindrical body preferably has a thickness of approximately 1 mm; an outer diameter of the cylindrical body preferably is approximately 28 mm; and the perforated wall has a thickness of approximately 1 mm. Preferably the openings in the perforated wall each are oval and have a diameter of approximately 4 mm.

The openings serve as drainage and ventilation holes allowing water to drain from and air to circulate within the enclosed passageway of the pool noodle while preventing the entry of snakes, animals, insects, and other debris and foreign matter. The holes are relatively small compared to the diameter of the hollow core of the pool noodle. In this respect, the holes allow air to circulate and prevent mold and mildew growth but are small enough to block insects and other debris and foreign matter.

FIG. 10 of the Application Publication is a top view of an alternative prototype plug 300 in accordance with one or more aspects and features of the invention. Additionally, FIG. 11 of the Application Publication is a side elevational view of the prototype plug 300, which elevational view is representative of the elevational views of the front, rear, and sides of this prototype plug 300.

The prototype plug 300 primarily differs from the prototype plug 200 in that the cylindrical body is solid and does not include the hollow interior space so as to be cup shaped. The prototype plug does still include the openings, but the openings extend the entire extent of the length of the plug from one side to the other in order for server as drainage and ventilation holes allowing water to drain from and air to circulate within the enclosed passageway of the pool noodle while preventing the entry of snakes, animals, insects, and other foreign matter.

FIG. 12 of the Application Publication is a perspective view of the prototype plug 300 having been entirely inserted into a passageway defined by a hollow core 202 of a pool noodle 204 and located proximate a longitudinal end of the pool noodle. FIG. 3 herein corresponds to FIG. 12 of the Application Publication. Moreover, FIG. 13 of the Application Publication is another perspective view of the flotation apparatus 306 of FIG. 12 of the Application Publication comprising the plug 300 and the pool noodle 204.

FIG. 14 of the Application Publication is a top perspective view of three prototype plugs in accordance with one or more aspects and features of the invention. The three prototype plugs include the aforementioned plugs 200,300 as well as an additional third, alternative prototype plug 400. FIG. 15 of the Application Publication is a perspective view of the three prototype plugs 200,300,400.

The prototype plug 400 differs from the prototype plug 200 in that the walls are thicker. The plug 400 is configured with the perforated bottom wall and the side walls of the cylindrical body having a thickness of 2 mm instead of 1 mm.

It is believed that among the three prototype plugs 200, 300,400, the best or most preferred are plugs 200,300 and, most preferred is plug 200. First, a plug with the semi-hollow design rather than a solid design is preferred because the semi-hollow design is preferable because of the less mass, reducing the likelihood that the plug will slip out and less likelihood of injury or damage if contact is made with a person or object. The semi-hollow design also reduces the amount of material needed to manufacture the product, reducing the cost of both manufacturing and shipping. While both plugs 200 and 400 exhibit the semi-hollow design, plug 200 is most preferred because of its reduced thickness of its walls and its consequent reduction in mass. Nonetheless, all three plug designs are effective.

A method of preventing bugs, mice, and snakes from entering a hollow core of a pool noodle that defines a passageway between first and second opposite, longitudinal ends of the pool noodle, comprises the steps of inserting a plug like that of plugs 200,300,400 into the hollow core at the first end of the pool noodle such that the first plug is entirely contained within the hollow core and does not extend from the passageway; and inserting a second plug like that of plugs 200,300,400 into the hollow core at the second end of the pool noodle such that the second plug is entirely contained within the hollow core and does not extend from the passageway. In performing this method, each plug is forcibly pushed into an open end of the passageway defined by the hollow core of the pool noodle such that the plug is secured in a friction fit with the walls of the passageway.

To enhance safety, the plug is inserted beyond an edge of the end of the pool noodle such that the plug is entirely inserted into the passageway and does not extend outside of the passageway, thereby minimizing the risk of injury if the noodle is swung and impacts a person or object. The plug is held securely in place by the friction fit between the outer surface of the plug and the inner wall surface of the passageway defined by the hollow core of the pool noodle. Protrusion of the plug is thus avoided, and the friction fit secures the placement of the plug within the pool noodle.

Additional embodiments, aspects, and features are set forth in the appendix to the specification, which is incorporated herein by reference. The appendix represents the inventor's notes regarding conceiving, reducing to practice, and testing embodiments, aspects, and features of the invention.

Based on the foregoing description, it will be readily understood by those persons skilled in the art that the invention has broad utility and application. Many embodiments and adaptations of the invention other than those specifically described herein, as well as many variations, modifications, and equivalent arrangements, will be apparent from or reasonably suggested by the invention and the foregoing descriptions thereof, without departing from the substance or scope of the invention.

Accordingly, while the invention has been described herein in detail in relation to one or more preferred embodiments, it is to be understood that this disclosure is only illustrative and exemplary of the invention and is made merely for the purpose of providing a full and enabling disclosure of the invention. The foregoing disclosure is not intended to be construed to limit the invention or otherwise exclude any such other embodiments, adaptations, variations, modifications or equivalent arrangements, the invention being limited only by the claims appended hereto and the equivalents thereof.

What is claimed is:

1. A flotation apparatus comprising:

(a) an elongate buoyant body having first and second opposite, longitudinal ends and a hollow core defining a passageway extending between the first and second opposite ends, the elongate buoyant body being buoyant in water; and (b) a first plug entirely located within the hollow core proximate the first longitudinal end and a second plug entirely located within the hollow core proximate the second longitudinal end, the first and second plugs configured to prevent bugs, mice, and snakes from entering the passageway extending between the first and second plugs;

(c) wherein an outer surface of each of the first and second plugs directly engages an inner wall surface of the hollow core in a friction fit; and (d) wherein an entirety of each plug, including an end of the plug closest to the respective longitudinal end, is spaced inwardly from an edge of the respective longitudinal end.

2. The floatation apparatus of claim 1, wherein each of the first and second plugs defines openings therein for venting moisture from the passageway extending between the first and second plugs.

3. The floatation apparatus of claim 1, wherein at least one of the first and second plugs is cup shaped.

4. The floatation apparatus of claim 1, wherein at least one of the first and second plugs comprise perforated pipe plugs.

5. The floatation apparatus of claim 1, wherein the elongate buoyant body is cylindrical in shape.

6. The floatation apparatus of claim 1, wherein the elongate buoyant body comprises a foam material.

7. The floatation apparatus of claim 1, wherein the passageway comprises a cylindrical passageway.

8. A flotation apparatus comprising:

(a) a pool noodle having first and second opposite longitudinal ends and a hollow core defining a passageway extending between the first and second longitudinal ends; and (b) a plug entirely located within the hollow core proximate the first longitudinal end, the plug being configured to prevent bugs, mice, and snakes from entering the hollow core of the pool noodle while permitting venting of moisture from the hollow core through the first longitudinal end, and the plug defining a plurality of openings in fluid communication with the passageway and with an exterior of the pool noodle through the first longitudinal end, thereby defining a drainage and ventilation path through the plug.

9. The flotation apparatus of claim 8, wherein an outer surface of the plug directly engages an inner wall surface of the hollow core in a friction fit, and wherein an entirety of the plug, including an end of the plug closest to the first longitudinal end, is spaced inwardly from an edge of the first longitudinal end.

10. An apparatus comprising a plug configured to be inserted into a hollow core of a pool noodle at a longitudinal end of the pool noodle such that the plug is entirely received within the hollow core of the pool noodle, wherein an outer surface of the plug is configured to directly engage an inner wall surface of the hollow core in a friction fit, and wherein the plug is configured to be positioned such that an entirety of the plug, including an end of the plug closest to the longitudinal end, is spaced inwardly from an edge of the longitudinal end.

11. The apparatus of claim 10, wherein the plug is configured with a cylindrical body with a first end that is open ended and a second end that is closed off by a perforated wall, wherein the cylindrical body has a hollow interior bounded by a cylindrical sidewall free of openings, and wherein the perforated wall defines a plurality of discrete openings located only in the perforated wall.

12. The apparatus of claim 11, wherein the cylindrical body extends approximately 20 mm between the opposite ends of the plug.

13. The apparatus of claim 11, wherein a side wall of the cylindrical body has a thickness of approximately 1 mm.

14. The apparatus of claim 11, wherein a side wall of the cylindrical body has a thickness of approximately 2 mm.

15. The apparatus of claim 11, wherein the plug is configured with an outer diameter of the cylindrical body being approximately 28 mm.

16. The apparatus of claim 11, wherein the perforated wall has a thickness of approximately 1 mm.

17. The apparatus of claim 11, wherein the perforated wall has a thickness of approximately 2 mm.

18. The apparatus of claim 11, wherein the perforated wall comprises a plurality of oval openings each having a diameter of approximately 4 mm.

19. The apparatus of claim 11, wherein the cylindrical body extends approximately 20 mm between the first and second ends and has an outer diameter of approximately 28 mm, wherein the cylindrical sidewall and the perforated wall each have a thickness of approximately 1 mm, and the perforated wall defines nine oval openings each having a diameter of approximately 4 mm.

* * * * *